US006082613A

United States Patent [19]

Mikulski et al.

[11] Patent Number: 6,082,613

[45] Date of Patent: Jul. 4, 2000

[54] INTERPLANT BULK SHIPMENT CONTAINERS

[75] Inventors: Barry S. Mikulski, Maple Grove; Douglas A. Greven, Bloomington; Richard L. Parker, Apple Valley, all of Minn.

[73] Assignee: General Mills, Inc., Minneapolis, Minn.

[21] Appl. No.: 09/131,596

[22] Filed: Aug. 10, 1998

[51] Int. Cl.[7] ..... B65D 90/04

[52] U.S. Cl. ..... 229/117.35; 229/117.27; 383/121

[58] Field of Search ..... 229/117.27, 117.35, 229/199, 125.38; 383/71, 104, 121

[56] References Cited

U.S. PATENT DOCUMENTS

| | | | |
|---|---|---|---|
| 1,140,231 | 5/1915 | Agar | 229/199 |
| 1,664,308 | 3/1928 | Miller | 229/919 |
| 2,337,370 | 12/1943 | Broadfoot | 229/125.38 |
| 3,019,961 | 2/1962 | Pulliam | 383/71 |
| 3,021,044 | 2/1962 | Schubert . | |
| 3,097,781 | 7/1963 | Masi . | |
| 3,162,351 | 12/1964 | Rudofski | 229/918 |
| 3,227,137 | 1/1966 | Goldman et al. | 229/117.35 |
| 3,291,364 | 12/1966 | Fischer . | |
| 3,294,306 | 12/1966 | Areddy . | |
| 3,539,360 | 11/1970 | Wood | 229/117.35 |
| 3,568,912 | 3/1971 | Desimas . | |
| 3,650,459 | 3/1972 | Tucker . | |
| 3,739,977 | 6/1973 | Shapiro et al. | 383/104 |
| 3,899,123 | 8/1975 | Stollberg et al. | 229/192 |
| 3,970,241 | 7/1976 | Hanson | 383/104 |
| 3,995,736 | 12/1976 | Lawson et al. . | |
| 4,064,302 | 12/1977 | Kozlowski et al. | 383/71 |
| 4,081,124 | 3/1978 | Hall . | |
| 4,158,410 | 6/1979 | Novatny | 229/125.38 |
| 4,296,860 | 10/1981 | Hsu et al. . | |
| 4,596,040 | 6/1986 | LaFleur et al. . | |
| 4,762,226 | 8/1988 | Gatton . | |
| 4,874,125 | 10/1989 | Bates | 229/918 |
| 4,897,982 | 2/1990 | Day et al. | 229/117.35 |
| 5,044,775 | 9/1991 | Rutledge | 383/71 |
| 5,111,938 | 5/1992 | Soprano et al. . | |
| 5,433,335 | 7/1995 | Raudalus et al. | 229/117.35 |
| 5,450,998 | 9/1995 | Esse et al. . | |

FOREIGN PATENT DOCUMENTS

| | | | |
|---|---|---|---|
| 1165276 | 10/1958 | France | 229/198.1 |

*Primary Examiner*—Gary E. Elkins
*Attorney, Agent, or Firm*—John A. O'Toole; Douglas J. Taylor; Alan D. Kamrath

[57] ABSTRACT

An interplant bulk shipment container (10) includes a liner bag (112) of a size for form fitting inside of a tote (12) formed of planar material panels (14, 16, 18, 20) of a rigidity and compressive strength allowing stacking thereof. The liner bag (112) is formed from flexible, plastic liner material. The bottom of the liner bag (112) is formed by securement of the front and back gussets (**118*a*, 118*b*, 120*a*, 120*b*) to the front and back sheets (114, 116), respectively, along gusset line securements (130*a*, 130*b*, 132*a*, 132*b*) extending at an acute angle to the interconnections of the front and back sheets (114, 116) to the side sheets (118, 120) and which interconnect with a bottom line securement (128) securing the front and back sheets (114, 116) together and extending generally perpendicular to the interconnections of the front and back sheets (114, 116) to the side sheets (118, 120). The free upper end of the liner bag (112) is free of interconnection between the sheets (114, 116, 118, 120**).

14 Claims, 2 Drawing Sheets

INTERPLANT BULK SHIPMENT CONTAINERS

BACKGROUND

The present invention generally relates to containers, particularly to containers for shipment of bulk products, and specifically to bulk shipment containers including liner bags located inside of a tote formed of inexpensive, lightweight material providing the necessary rigidity and compressive strength required for use and stacking.

During the manufacture of many products into their final commercialized form, it is often desired to temporarily store or transport partially manufactured products, components, or the like. Totes are often utilized to contain such products, components, or the like in bulk while allowing handling by forklifts, trucks, or the like. Especially when transported to other facilities, it is desired that the totes be formed of lightweight material. The use of lightweight material is important in minimizing the overall mass required to be handled and/or transported. Further, reduction in the mass and/or volume of the material forming the tote maximizes the total volume for holding products, components, or the like while reducing the amount of material requiring disposal. Additionally, the reduction in the amount of material required to form the tote typically translates into reduction in costs. However, the tote must provide the necessary rigidity and compressive strength required for use and stacking. An example of a tote that meets these criteria and which can be utilized for this purpose is disclosed in U.S. Pat. No. 5,450,998.

Double-wall corrugated board has been one material from which totes have been manufactured. Especially when utilized for food products, plastic liner bags are placed inside of the tote for receiving the product and protecting the product during storage and shipment. Currently, liner bags which are commercially available for bulk shipment totes include internal bottom gussets. When liner bags of the industry standard design are utilized, significant amounts of product are trapped in folds and crevices in the liner bag especially at the bottom of the liner bag which abuts with the bottom panel of the tote, with such trapped product having a tendency of remaining in the liner when the bulk shipment container is dumped at the desired processing location. Thus, significant costs are incurred due to the additional manual effort required to attempt to obtain access for removal of the trapped product and due to product which is lost to production as well as disposal expenses for such lost product. Additionally, the presence of trapped product in the liner bag after use severely hampers and can eliminate the ability to recycle the liner bag itself at the end of its useful life.

Although containers of other designs are commercially available, such commercially available containers have various deficiencies so as not to lend themselves for bulk shipment. In particular, such deficiencies include but are not limited to being of a size which is not practical for bulk shipment, including outlet spouts at the lower portion of the container, including fill openings of a significantly reduced size, being of a collapsible design which does not provide the necessary rigidity and compressive strength for stacking and use, and the like.

Thus, a need continues to exist for improved totes which overcome the many disadvantages and shortcomings of existing bulk shipment container designs. Specifically, a need exists for bulk shipment containers formed of lightweight, planar material able to retain its planar shape in an unfilled condition, which can be easily filled and dumped, and which can be otherwise utilized as conventional bulk shipment containers but which eliminate or substantially minimize trapping of product in the liner bag which would not be readily accessible or available when the product is desired to be removed from the bulk shipment containers.

SUMMARY

The present invention solves these needs and other problems in the field of bulk shipment containers by providing, in the preferred form, a liner bag of a size for form fitting inside of a tote formed of planar material panels of a rigidity and compressive strength allowing stacking thereof, with the liner bag being formed from flexible, plastic liner material, with the bottom of the liner bag being formed by securement of the front and back gussets to the front and back sheets, respectively, along gusset line securements extending at an acute angle to the interconnections of the front and back sheets to the side sheets and which interconnect with a bottom line securement securing the front and back sheets together and extending generally perpendicular to the interconnections of the front and back sheets to the side sheets and while the free upper end is free of interconnection between the sheets.

It is thus an object of the present invention to provide a novel container for bulk shipment of products.

It is further an object of the present invention to provide such a novel bulk shipment container including a liner bag which is form-fitted to a tote.

It is further an object of the present invention to provide such a novel bulk shipment container having a liner bag including the bottom gussets located outside of the liner bag.

It is further an object of the present invention to provide such a novel bulk shipment container having a liner bag which readily conforms to the interior of a tote.

It is further an object of the present invention to provide such a novel bulk shipment container which can be stacked.

It is further an object of the present invention to provide such a novel bulk shipment container for handling by forklifts, trucks, or the like.

It is further an object of the present invention to provide such a novel bulk shipment container which can be easily dumped.

It is further an object of the present invention to provide such a novel bulk shipment container eliminating or substantially minimizing trapping of product when it is desired to remove the product from the bulk shipment container.

It is further an object of the present invention to provide such a novel bulk shipment container significantly reducing product lost as the result of being contained within and removed from the bulk shipment container.

It is further an object of the present invention to provide such a novel bulk shipment container reducing labor requirements in the removal of product from the bulk shipment container.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
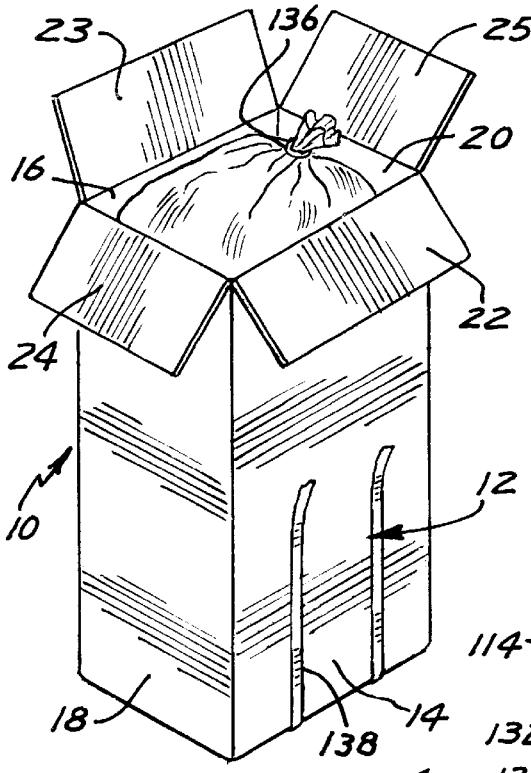
FIG. 1 shows a perspective view of a bulk shipment container according to the preferred teachings of the present invention with the upper end of the liner bag being crimped, twisted and secured and the upper closure flaps of the tote being in an open position.
Figure 2:
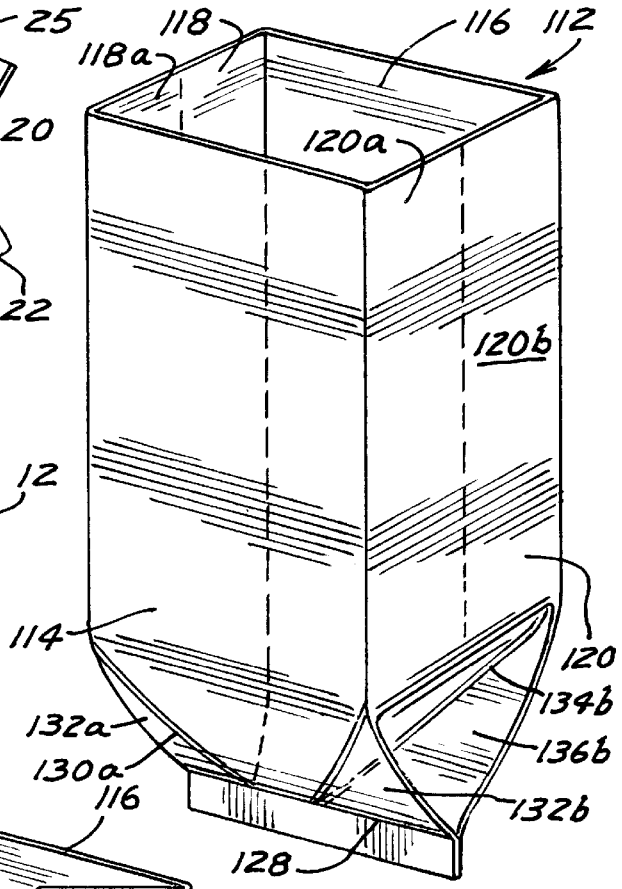
FIG. 2 shows a perspective view of the liner bag of the bulk shipment container of FIG. 1 in a partially opened condition.
Figure 3:
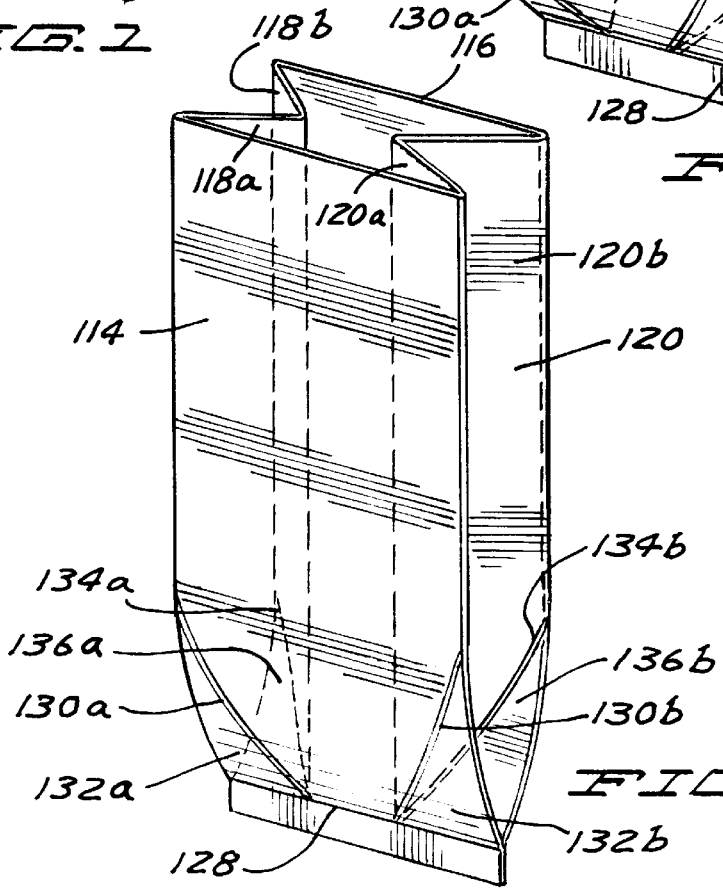
FIG. 3 shows a perspective view of the liner bag of the bulk shipment container of FIG. 1 slightly expanded from a flat, folded condition.
Figure 4:
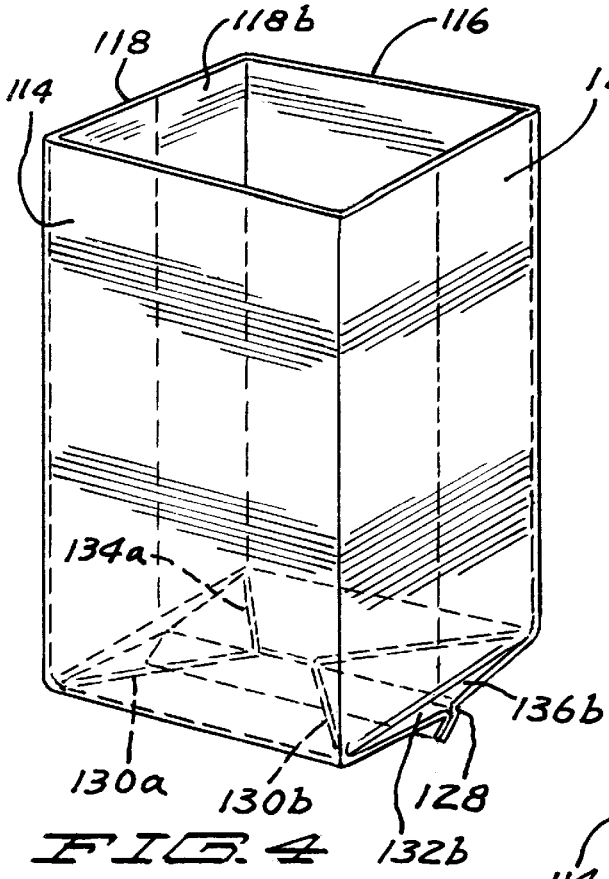
FIG. 4 shows a perspective view of the liner bag of the bulk shipment container of FIG. 1 in a fully opened condition.
Figure 5:
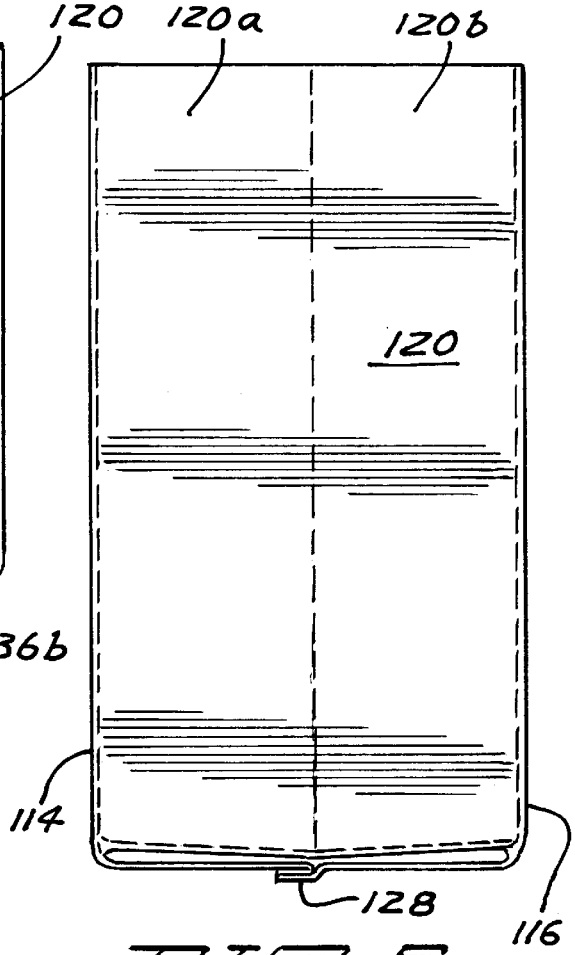
FIG. 5 shows a side elevational view of the liner bag of FIG. 4.
Figure 6:
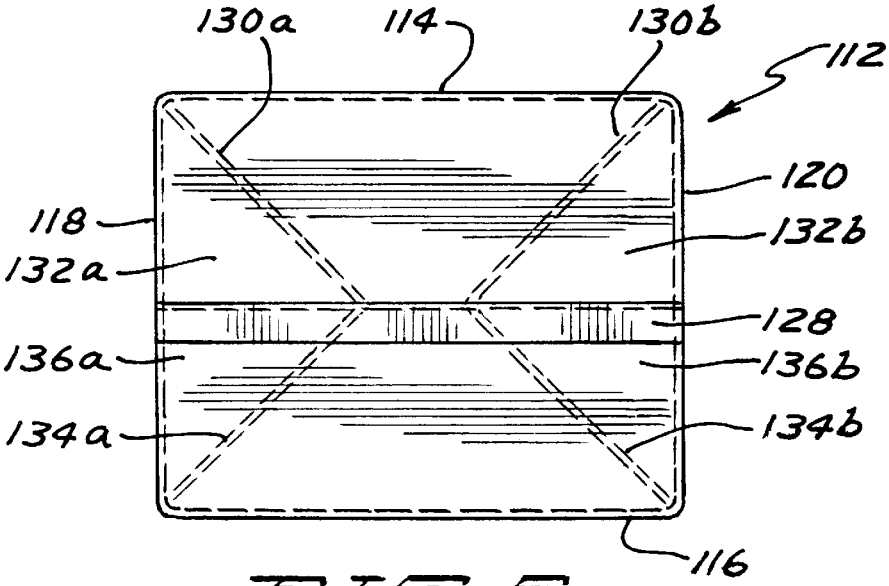
FIG. 6 shows a bottom plan view of the liner bag of FIG. 4.

All figures are drawn for ease of explanation of the basic teachings of the present invention only; the extensions of the figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the description has been read and understood.

Where used in the various figures of the drawings, the same numerals designate the same or similar parts. Furthermore, when the terms "top", "bottom", "first", "second", "inside", "outside", "front", "back", "upper", "lower", "height", "width", "length", "thickness", "side", "horizontal", "vertical", and similar terms are used herein, it should be understood that these terms have reference only to the structure shown in the drawings as it would appear to a person viewing the drawings and are utilized only to facilitate describing the illustrative embodiment.

DESCRIPTION

An interplant bulk shipment container according to the preferred teachings of the present invention is shown in the drawings and generally designated 10. Generally, container 10 according to the teachings of the present invention includes a tote 12 which can be of a variety of constructions such as but not limited to the type disclosed in U.S. Pat. No. 5,450,998 or illustrated in the drawings. Such tote 12 generally comprises a plurality of body walls, such as front and back panels 14 and 16 and first and second side panels 18 and 20 which are hingedly connected together along hinge connections into an annularly continuous tubular configuration in any suitable manner. First and second side panels 18 and 20 extend generally perpendicular between front and back panels 14 and 16 in a spaced manner. Such body walls may have any suitable dimensional relationship, but in the embodiment illustrated, front and back panels 14 and 16 are of a horizontal width slightly greater than the horizontal width of side panels 18 and 20. All of such walls have equal vertical length, however.

Hingedly connected to tote 12 at opposite ends thereof are tote closure means in the form of opposite cooperable pairs of closure flaps 22–25 which are intended to seal the top and bottom of tote 12. Corresponding flaps 22–25 at opposite ends of tote 12 generally are identical. Particularly, hingedly connected to the margin or edge of each of front and back panels 14 and 16 are upper and lower end closure flaps 22 and 23, respectively. A pair of side closure side flaps 24 and 25 are hingedly connected to the margins or edges of opposite side panels 18 and 20, respectively.

Flaps 22–25 in the most preferred form have widths which 20 are equal to the widths of panels 14, 16, 18, and 20 to which they are hingedly connected and have lengths from their outer free edges to their hinged connections to panels 14, 16, 18, and 20. In the preferred form, the lengths of flaps 24 and 25 are generally equal to one half of the width of panels 14 and 16 and the lengths of flaps 22 and 23 are generally equal to one half of the widths of panels 18 and 20.

In the preferred form, lower closure flaps 24 and 25 are pivoted relative to panels 18 and 20 to extend generally perpendicular thereto, with their outer free edges in a generally abutting relation. Similarly, lower closure flaps 22 and 23 are pivoted relative to panels 14 and 16 to extend generally perpendicular thereto, with the outer free edges in a generally abutting relation and with the inside surfaces of lower closure flaps 22 and 23 abutting with the outside surfaces of lower closure flaps 24 and 25. Lower closure flaps 22–25 are suitably secured together such as by adhesive between the outside surfaces of flaps 24 and 25 and the inside surfaces of flaps 22 and 23, by staples extending between flaps 22–25, or the like. The secured, lower closure flaps 22–25 define a bottom panel which in the preferred form has double the thickness of panels 14, 16, 18, and 20. Panels 14, 16, 18, and 20 upstand generally perpendicular to the bottom panel and terminate in upper edges at equal heights above the bottom panel.

In the most preferred form, tote 12 is formed of planar material able to retain its planar shape in static conditions, and in the most preferred form is formed by a single, integral component which is adhered into a tubular configuration and folded to form and define panels 14, 16, 18, and 20 and flaps 22–25. In its most preferred form, tote 12 and the single, integral component is corrugated cardboard.

Container 10 according to the teachings of the present invention further includes a liner bag 112 formed of flexible, plastic liner material. Bag 112 generally comprises a plurality of sheets such as front and back sheets 114 and 116 and first and second side sheets 118 and 120 which are hingedly connected together along flexible connections into an annularly contiguous tubular configuration in any suitable manner. Front and back sheets 114 and 116 have equal horizontal widths which are generally equal to the horizontal widths of front and back panels 114 and 116. Similarly, first and second side sheets 118 and 120 have equal horizontal widths which are generally equal to the horizontal widths of first and second side panels 18 and 20. In the most preferred form, the horizontal widths of first and second side sheets 118 and 120 have horizontal widths which are less than the horizontal widths of front and back sheets 114 and 116 and specifically which are approximately 80% the horizontal widths of front and back sheets 114 and 116. All of the sheets have equal vertical lengths which in the preferred form is considerably greater than the lengths of panels 14, 16, 18, and 20. In the preferred form, front and back sheets 114 and 116 have a width of approximately 52 inches (132 cm), side sheets 118 and 120 have a width of approximately 43 inches (109 cm), and sheets 114, 116, 118, and 120 have a length of approximately 108 inches (275 cm).

In the preferred form, first and second side sheets 118 and 120 are folded inwardly to define front gussets 118*a* and 120*a* and back gussets 118*b* and 120*b*, respectively. In a flat condition, the inside surfaces of front gussets 118*a* and 120*a* abut with the inside surface of front sheet 114, and the inside surfaces of back gussets 118*b* and 120*b* abut with the inside surface of back sheet 116. In the most preferred form and due to the lesser width of sheets 118 and 120 than sheets 114 and 116, the interconnection between gussets 118*a* and 118*b* and the interconnection between gussets 120*a* and 120*b* are in a spaced, parallel relation and without side sheets 118 and 120 overlying one another.

Liner bag 112 according to the teachings of the present invention includes a bottom line securement 128 which secures front and back sheets 114 and 116 together with side sheets 118 and 120 sandwiched therebetween. In particular, bottom line securement 128 extends generally perpendicularly between the interconnections of front and back gussets 118*a*, 118*b*, 120*a*, and 120*b* to front and back sheets 114 and 116, with bottom line securement 128 sealing the inside surfaces of front gussets 118*a* and 120*a* to front sheet 114, the outside surfaces of front gussets 118*a* and 120*a* to the outside surfaces of back gussets 118*b* and 120*b*, respectively, the inside surfaces of back gussets 118*b* and 120*b* to back sheet 116, and the inside surface of front sheet 114 to the inside surface of back sheet 116 intermediate the interconnection between gussets 118*a* and 118*b* and the interconnection between gussets 120*a* and 120*b*. In the preferred form, bottom line securement 128 is spaced slightly above and parallel to the bottom edges of sheets 114, 116, 118, and 120.

Liner bag 112 according to the teachings of the present invention includes first and second front gusset line securements 130*a* and 130*b* for securing front gussets 118*a* and 120*a* to front sheet 114. In particular, front gusset line securements 130*a* and 130*b* extend from points at the interconnections of the front gussets 118*a* and 120*a* to front sheet 114 at an acute angle of approximately 45° to points on bottom line securement 128 and in the preferred form the bottom edges of sheets 114 and 116. In the most preferred form, front gusset line securements 130*a* and 130*b* interconnect with bottom line securement 128 at the interconnections of gussets 118*a* and 118*b* and of gussets 120*a* and 120*b*, respectively. Thus, front gusset line securements 130*a* and 130*b* have a generally V-shape when liner bag 112 is in a flat folded condition. First and second front triangular shaped wall portions 132*a* and 132*b* are defined by bottom line securement 128, front gusset line segments 130*a* and 130*b*, and the interconnection between front sheet 114 and front gussets 118*a* and 120*a*, respectively.

Similarly, first and second back gusset line securements 134*a* and 134*b* secure back gussets 118*b* and 120*b* to back sheet 116. In particular, back gusset line securements 134*a* and 134*b* extend from points at the interconnections of the back gussets 118*b* and 120*b* to back sheet 116 at an acute angle of approximately 45° to points on bottom line securement 128 and in the preferred form the bottom edge of sheets 114 and 116. In the most preferred form, back gusset line securements 134*a* and 134*b* interconnect with bottom line securement 128 at the interconnections of gussets 118*a* and 118*b* and of gussets 120*a* and 120*b*, respectively. Thus, back gusset line securements 134*a* and 134*b* have a generally V-shape which is overlain by front gusset line securements 130*a* and 130*b* when liner bag 112 is in a flat folded condition. First and second back triangular shaped wall portions 136*a* and 136*b* are defined by bottom line securement 128, back gusset line segments 134*a* and 134*b*, and the interconnections between back sheet 116 and back gussets 118*b* and 120*b*, respectively.

In the most preferred form, line securements 128, 130*a*, 130*b*, 134*a*, and 134*b* are formed by clamping liner bag 12 between heat jaws which melt or otherwise fuse sheets 114, 116, 118, and 120 together at the desired location. However, line securements 128, 130*a*, 130*b*, 134*a*, and 134*b* can be formed by other manners according to the teachings of the present invention including but not limited to by adhesive.

Liner bag 112 can be manually opened and placed in tote 12 in the following manner. In particular, triangular shaped wall portions 132*a*, 132*b*, 136*a*, and 136*b* can be pivoted about bottom line securement 128 into a single plane. Thus, a first triangular shaped bottom portion is formed having sides defined by gusset line segments 130*a* and 134*a* and the interconnections between gussets 118*a* and 120*a* with front and back sheets 114 and 116. Similarly, a second triangular shaped bottom portion is formed having sides defined by gusset line segments 130*b* and 134*b* and the interconnection between gussets 118*b* and 120*b* with front and back sheets 114 and 116.

Thereafter, first side sheet 118 can be pushed downward to pivot about gusset line segments 130*a* and 134*a* to flushly abut with the first triangular shaped bottom portion, with the interconnection between gussets 118*a* and 118*b* overlying bottom line securement 128. Similarly, second side sheet 120 can be pushed downward to pivot about gusset line segments 130*b* and 134*b* to flushly abut with the second triangular shaped bottom portion, with the interconnection between gussets 120*a* and 120*b* overlying bottom line securement 128.

First side-sheet 118 can be folded to extend generally perpendicular to the first triangular shaped bottom portion and extend generally upwardly from the interconnection of side sheet 118 with front and back sheets 114 and 116 between the interconnection points with gusset line securements 130*a* and 134*a*. Similarly, second side sheet 120 can be folded to extend generally perpendicular to the second triangular shaped bottom portion and extend generally upwardly from the interconnection of side sheet 120 with front and back sheets 114 and 116 between the interconnection points with gusset line securements 130*b* and 134*b*. Likewise, front sheet 114 can be folded about a line extending between the interconnection points of front gusset line segments 130*a* and 130*b* with the interconnection of side sheets 118 and 120 with front sheet 114 to define a front, trapezoid shaped bottom portion having its minor base located along bottom line securement 128 lying in the same plane as the first and second triangular shaped bottom portions. The remaining portion of front sheet 114 can extend upward generally perpendicularly from the major base of the front, trapezoid shaped bottom portion. Similarly, back sheet 116 can be folded about a line extending between the interconnection points of back gusset line segments 134*a* and 134*b* with the interconnection of side sheets 118 and 120 with back sheet 116 to define a back, trapezoid shaped bottom portion having its minor base located along bottom line securement 128 lying in the same plane as the first and second triangular shaped bottom portions and the front, trapezoid shaped bottom portion. The remaining portion of back sheet 116 can extend upward generally perpendicular from the major base of the back, trapezoid shaped bottom portion.

Liner bag 112 according to the teachings of the present invention can be opened to include a generally planar rectangular bottom defined by the first and second triangular shaped bottom portions and the front and back trapezoid shaped bottom portions and of a size generally equal to and for aligning and abutting with the bottom panel of tote 12. In particular, the portions of gussets 118*a*, 118*b*, 120*a*, and 120*b* which form the bottom of liner bag 112 according to the teachings of the present invention are located outside of the interior of liner bag 112 and are not located inside of liner bag 112. When opened, the remaining portions of front and back sheets 114 and 116 and side sheets 118 and 120 extending upward from the generally planar rectangular bottom are of a size generally equal to and for aligning and abutting with front and back panels 14 and 16 and side panels 18 and 20, respectively. In the preferred form, sheets 114, 116, 118, and 120 have a length which extends beyond the top of panels 14, 16, 18, and 20. Thus, liner bag 112 conforms exactly to and is form fitted in interior of tote 12.

According to the teachings of the present invention, when filled with a food product such as cereal half products, there are no crevices formed by the folding of sheets 114, 116, 118, and 120 against themselves or against each other. Especially important in this regard is the provision of gusset line securements 130*a*, 130*b*, 134*a*, and 134*b* which allows defining a flat bag bottom without folds which extend into the interior of liner bag 112 in an opened condition. Equally important is that tote 12 is formed of panels 14, 16, 18, and 20 which are able to retain their planar shape even when not filled with product. Thus, bag liner 112 can be manually positioned inside of tote 12 to insure that excess length of bag liner 112 is not present which can roll inside the interior of tote 12 during filling of container 12 and to insure that sheets 114, 116, 118, and 120 align with panels 14, 16, 18, and 20 and the interconnections between sheets 114, 116, 118, and 120 align with the interconnections between panels 14, 16, 18, and 20.

After liner bag 112 is positioned inside and aligned with tote 12, product can be loaded into liner bag 112 located in tote 12. Container 10 according to the teachings of the present invention is advantageous in the ability to quickly load without requiring accurate alignment of a product outlet chute. In particular, front and back sheets 114 and 116 and side sheets 118 and 120 are free of interconnection from the free upper end to the bag bottom to create an inlet opening of a size generally corresponding to the perimeter of tote 12 defined by panels 14, 16, 18, and 20. In addition, the height of liner bag 112 between the free upper end to the bag bottom is considerably greater than the height of panels 14, 16, 18, and 20 of tote 12 so that liner bag 112 can be extended above tote 12 so that the product outlet chute can be positioned within or closely adjacent liner bag 112 to reduce the escape of product dust into the environment.

After liner bag 112 is loaded with the desired amount of product, the free upper end of liner bag 112 can be crimped together and twisted. The crimped and twisted free upper end of liner bag 112 is suitably secured such as by use of a plastic tie strap 136. The secured, free upper end of liner bag 112, the product and liner bag 112 are then positioned in tote 12 so that liner bag 112 is located at a level below the upper ends of panels 14, 16, 18, and 20. At that time, upper closure flaps 24 and 25 can be pivoted relative to panels 18 and 20 to extend generally perpendicular thereto, with their outer free edges in a generally abutting relation. Similarly, upper closure flaps 22 and 23 are pivoted relative to panels 14 and 16 to extend generally perpendicular thereto, with the outer free edges in a generally abutting relation and with the inside surfaces of upper closure flaps 22 and 23 abutting with the outside surfaces of upper closure flaps 24 and 25. The pivoted, upper closure flaps 22–25 define a top panel which in the preferred form has double the thickness of panels 14, 16, 18, and 20.

After upper closure flaps 22–25 are pivoted to form the top panel of tote 12, upper closure flaps 22–25 are suitably secured such as by plastic straps 138 extending around the top and bottom panels and front and back panels 14 and 16 and/or side panels 18 and 20. Container 10 in a secured condition can be easily transported such as by a fork lift to a storage or other location or to a truck for transport to another plant or warehouse.

When it is desired to utilize the product inside of container 10 and container 10 has been transported to the desired location, plastic straps 138 can be removed such as by cutting. Thereafter, closure flaps 22–25 can be pivoted relative to panels 14, 16, 18, and 20 to an open condition including but not limited to where one or more of the outside surfaces of closure flaps 22–25 abut with or are closely adjacent to the outside surfaces of respective panels 14, 16, 18, and 20. After tote 12 has been opened, tie strap 136 can be removed such as by cutting. Thereafter, the free upper end of liner bag 112 can be untwisted and sheets 114, 116, 118, and 120 can be separated from each other to provide a large access opening to the interior of liner bag 112. If desired, the free upper end of liner bag 112 can be rolled downward outside of liner bag 112. After liner bag 112 has been opened, the product can be removed therefrom such as by scooping therefrom or by dumping from container 10. Container 10 according to the teachings of the present invention is advantageous in allowing the complete removal of the product from container 10. In particular, product is not trapped in folds or crevices in liner bag 112 and would be otherwise inaccessible as was a serious problem in prior interplant bulk shipment containers. Specifically, due to the preferred manner that liner bag 112 and in particular the bottom thereof is formed, liner bag 112 of the teachings of the present invention can be manually positioned in tote 12 in an aligned manner and without folds, crevices, or other voids in which product could be trapped.

After the product has been removed from container 10, container 10 can be disposed of or prepared for reuse in a conventional manner. However, as any residual product remaining in container 10 is substantially eliminated and dramatically minimized, disposal expenses for residual product is similarly substantially eliminated and dramatically minimized. Additionally, being substantially free of residual product, liner bags 112 are not impaired in the ability to be recycled in the normal course and specifically without encountering the problems associated with attempting to recycle prior liner bags of bulk shipment containers for breakfast cereal products, snacks, and like cereal grain products.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Interplant bulk shipment container comprising, in combination: a tote including a bottom panel, a front panel, a back panel, and first and second side panels, with the front, back and side panels upstanding generally perpendicular to the bottom panel, with the first and second side panels extending generally perpendicular between the front and back panels in a spaced manner, with the front, back and side panels terminating in upper edges at equal heights above the bottom panel, with the front and back panels having equal widths, with the first and second side panels having equal widths, with the bottom, front, back, and side panels being formed of planar material able to retain its planar shape in static conditions; and a liner bag including a front sheet, a back sheet, and first and second side sheets each formed of flexible liner material, with the front and back sheets having equal widths equal to the widths of the front and back panels, with the first and second side sheets having equal widths equal to the widths of the first and second side panels, with the first and second side sheets each being folded inwardly to define front and back gussets, with the inside surfaces of the front gussets in a flat, folded condition abutting with the inside surface of the front sheet and the inside surfaces of the back gussets abutting with the inside surface of the back sheet, with the front gussets being secured to the front sheet along front gusset lines extending from points at the interconnection of the front gussets to the front sheet and at an acute angle, with the back gussets being secured to the back sheet along back gusset lines extending from points at the interconnection of the back gussets to the back sheet and at the acute angle, with the front and back sheets being secured together along a bottom line extending generally perpendicularly between the interconnections of the front and back gussets to the front and back sheets, with the gusset lines interconnecting with the bottom line, with the bag bottom of the liner bag being formed and defined by the gusset and bottom lines, with the liner bag having a free upper end spaced from the bag bottom at a height considerably greater than the height of the front, back, and side panels, with the first and second side sheets, the front sheet, and the back sheet being free of interconnection from the free end to the bag bottom; and wherein first and second front triangular shaped wall portions are defined by the bottom line, front gusset lines, and the interconnection between the front sheet and the front gussets; wherein first and second back triangular shaped wall portions are defined by the bottom line, back gusset lines, and the interconnection between the back sheet and the back gussets; and wherein the triangular shaped wall portions are pivotable about the gusset lines.

2. The bulk shipment container of claim 1 wherein the widths of the front and back sheets are greater than the widths of the first and second side sheets so that the interconnections between the front and back gussets are spaced when the liner bag is in the flat, folded condition.

3. The bulk shipment container of claim 2 wherein the front and back gusset lines interconnect with the bottom line at the interconnections between the front and back gussets.

4. The bulk shipment container of claim 1 wherein the acute angle is in the order of 45°.

5. The bulk shipment container of claim 1 wherein the front, back, side, and bottom panels are formed of corrugated cardboard.

6. The bulk shipment container of claim 5 wherein the liner bag is formed of plastic.

7. The bulk shipment container of claim 1 wherein the front, back and side sheets have a lower edge, with the bottom line being spaced from the lower edge.

8. The bulk shipment container of claim 7 wherein the front and back gusset lines extend to the lower edge.

9. The bulk shipment container of claim 8 wherein the front and back gusset lines interconnect with the bottom line at the interconnections between the front and back gussets.

10. The bulk shipment container of claim 1 further comprising, in combination: a plastic tie closure for the liner bag.

11. The bulk shipment container of claim 1 wherein the tote includes lower closure flaps hingedly connected to the bottom, front, back, and side panels, with the bottom panel formed by pivoting the lower closure flaps relative to the bottom, front, back, and side panels.

12. The bulk shipment container of claim 11 wherein the tote includes a top panel.

13. The bulk shipment container of claim 12 wherein the tote includes upper closure flaps hingedly connected to the bottom, front, back, and side panels, with the top panel formed by pivoting the upper closure flaps relative to the bottom, front, back, and side panels.

14. The bulk shipment container of claim 13 further comprising, in combination: plastic straps extending around the top and bottom panels for securing the upper closure flaps in the pivoted position.

* * * * *